US008756873B1

(12) United States Patent
Hire

(10) Patent No.: US 8,756,873 B1
(45) Date of Patent: Jun. 24, 2014

(54) TRANSFORMING AWNING

(76) Inventor: Mark Hire, Belleville, MI (US)

( * ) Notice: Subject to any disclaimer, the term of this patent is extended or adjusted under 35 U.S.C. 154(b) by 128 days.

(21) Appl. No.: 13/311,303

(22) Filed: Dec. 5, 2011

(51) Int. Cl.
*E04B 1/346* (2006.01)

(52) U.S. Cl.
USPC ..... 52/72; 52/473; 49/74.1; 49/82.1

(58) Field of Classification Search
USPC ..... 49/74.1, 77.1, 82.1; 454/250, 275, 276, 454/277, 281, 314, 358, 362; 52/71, 72, 52/473
See application file for complete search history.

(56) References Cited

U.S. PATENT DOCUMENTS 1,924,263 A * 8/1933 Truax ..... 49/77.1
2,780,983 A * 2/1957 De Roo ..... 49/77.1
2,847,929 A * 8/1958 Leigh ..... 49/77.1
3,044,387 A * 7/1962 Hinden ..... 49/77.1
3,125,944 A * 3/1964 Radcliff ..... 49/51
3,196,895 A * 7/1965 Dayus ..... 137/270
4,099,346 A * 7/1978 Isono ..... 49/82.1
4,241,647 A * 12/1980 Herr ..... 454/336
4,513,655 A * 4/1985 Dayus ..... 454/318
4,527,355 A * 7/1985 Numakami et al. ..... 49/82.1
5,203,394 A * 4/1993 Hailey ..... 160/166.1
5,306,210 A * 4/1994 Smit ..... 454/250
5,669,179 A * 9/1997 Hanlon ..... 49/64

FOREIGN PATENT DOCUMENTS

JP 2001329704 A * 11/2001 ..... E04H 1/12

* cited by examiner

*Primary Examiner* — Jerry Redman
(74) *Attorney, Agent, or Firm* — Jelic Patent Services, LLC; Stanley E. Jelic

(57) ABSTRACT

An awning configured to transform and can be opened, closed, or partially open. The awning attaches to the side of a building or structure and is supported with posts. The awning includes rectangular rafters with a J cross-sectional shape formed at the edge of one of the long sides, rectangular rafters with an L cross-sectional shape formed at the edge of one of the long sides, two ledgers which are each functionally connected to opposing short sides of the rectangular rafters at the face of the ledgers, and means to axially rotate the rafters about the length of the rafters up to 90 degrees.

7 Claims, 13 Drawing Sheets

TRANSFORMING AWNING

FIELD OF THE INVENTION

The present disclosure is in the technical field of building or structural attachments. More particularly, the present disclosure focuses on an awning configured to transform.

BACKGROUND OF THE INVENTION

Currently, awnings can to attach to the side of a building or structure and provide shelter. The shelter provided includes shade and protection from elements such as rain, sleet, and snow. Typically the awning is positioned to protect an opening in the building or structure, such as a doorway.

BRIEF SUMMARY OF THE INVENTION

The present disclosure describes an apparatus which can attach to the side of a structure or stand alone on posts. The apparatus is an awning configured to transform, which can provide a variable amount of shelter. The apparatus comprises: a plurality of rectangular rafters with a J cross-sectional shape formed at the edge of one of the long sides and an L cross-sectional shape formed at the opposing long side edge; two ledgers which are each functionally connected to opposing short sides of the rectangular rafters at the face of the ledgers; and means to axially rotate the rafters about the length of the rafters up to 90 degrees.

The plurality of rectangular rafters with a J cross-sectional shape formed at the edge of one of the long sides and an L cross-sectional shape formed at the opposing long side edge comprise: a rectangular side panel with a J cross-sectional shape side formed at the edge of one of the long sides and an L cross-sectional shape side formed at the opposing long side edge; and an axle with a cross-section which matches the J cross-sectional shape, runs axially along the J side of the side panel, and is secured to the side panel at the J side. The rafters are paired so that each rafter forms a mirror opposite to its paired rafter, except for the end rafters. Each pair of rafters empties precipitation into a shared rafter gutter which drains to a ledger gutter. The first end rafter has a slightly greater height than the paired rafters and the opposing end rafter has a slightly lesser height than the paired rafters.

In one embodiment, the rafters further comprise bumpers which are attached to the side panels. The bumpers serve to reduce vibration, noise, and rattling.

In another embodiment, the rafters further comprise insulation attached to the side panels.

In another embodiment, the rafters further comprise an alignment pin in the center of each side panel to prevent side panel bulging.

The ledgers comprise: a base with two long sides, two short sides, and two faces; a gutter which runs along the length of the long side of the base; and openings with bushings or bearings which functionally connect to each axle.

The functional connection between the rafters and the ledgers comprises an A-strut which is integrated with a gutter. The A-strut gutter accepts drainage from the rafters and sends it to a ledger gutter.

In another embodiment, the ledgers further comprise a cap on top of each ledger and a cap at each end of each ledger. The caps provide environmental protection to the ledgers.

Means to axially rotate the rafters about the length of the rafters up to 90 degrees comprise: a plurality of connecting rods with a hole to match the cross-sectional shape of the axles, each connecting rod being functionally attached to the end of one axle; a first linkage rod for each ledger which is able to transfer force to the first of each paired rafter via the connecting rods and axles; a second linkage rod for each ledger which is able to transfer force to the second of each paired rafter via the connecting rods and axles; means to exert force upon the first linkage rod; and means to exert force upon the second linkage rod. The means to exert force can be electro-mechanical or mechanical. Electro-mechanical means can be an electric motor or the like. The electric motor can be powered with solar energy, a battery, an AC connection to a house, or the like. Mechanical means can be a hand crank, cable-actuator combination, or the like.

One end of the apparatus can be functionally connected to a building or structure. On the end opposing the building or structure, the apparatus is elevated with sticks, rods, poles, posts or the like, which are functionally connected to the bottom of the ledgers. Alternately, the entire apparatus is free-standing and elevated with sticks, rods, poles, posts or the like, which are functionally connected to the bottom of the ledgers.

In another embodiment, the apparatus further comprises a screen functionally attached to the top of the unit. The screen can prevent unwanted leaves, bugs, debris, etc. from affecting the apparatus.

In another embodiment, the apparatus further comprises a wind sensor. The wind sensor could be used to control whether the apparatus is open, closed, or partially open.

The scope of the invention is defined by the claims, which are incorporated into this section by reference. A more complete understanding of embodiments on the present disclosure will be afforded to those skilled in the art, as well as the realization of additional advantages thereof, by consideration of the following detailed description of one or more embodiments. Reference will be made to the appended sheets of drawings that will first be described briefly.

The following detailed description of the invention is merely exemplary in nature and is not intended to limit the invention or the application and uses of the invention. Furthermore, there is no intention to be bound by any theory presented in the preceding background of the invention or the following detailed description of the invention.

DETAILED DESCRIPTION OF THE INVENTION

Some awnings are designed to be retractable or removable in order compensate for extreme weather conditions. However, retracting or removing an awning can be time consuming. Furthermore, retracting or removing an awning completely eliminates the ability for the awning to provide shelter while retracted or removed. Hence, a need exists for an apparatus to provide a variable amount of shelter. The amount of variable shelter is determined by the user's needs for shelter, which may include the need for shade or protection from precipitation.

The present disclosure describes an apparatus which fulfills the need for a variable amount of shelter which can be attached to the side of a building or structure. The apparatus is an awning configured to transform and can be opened, closed, or partially open.

Figure 1:
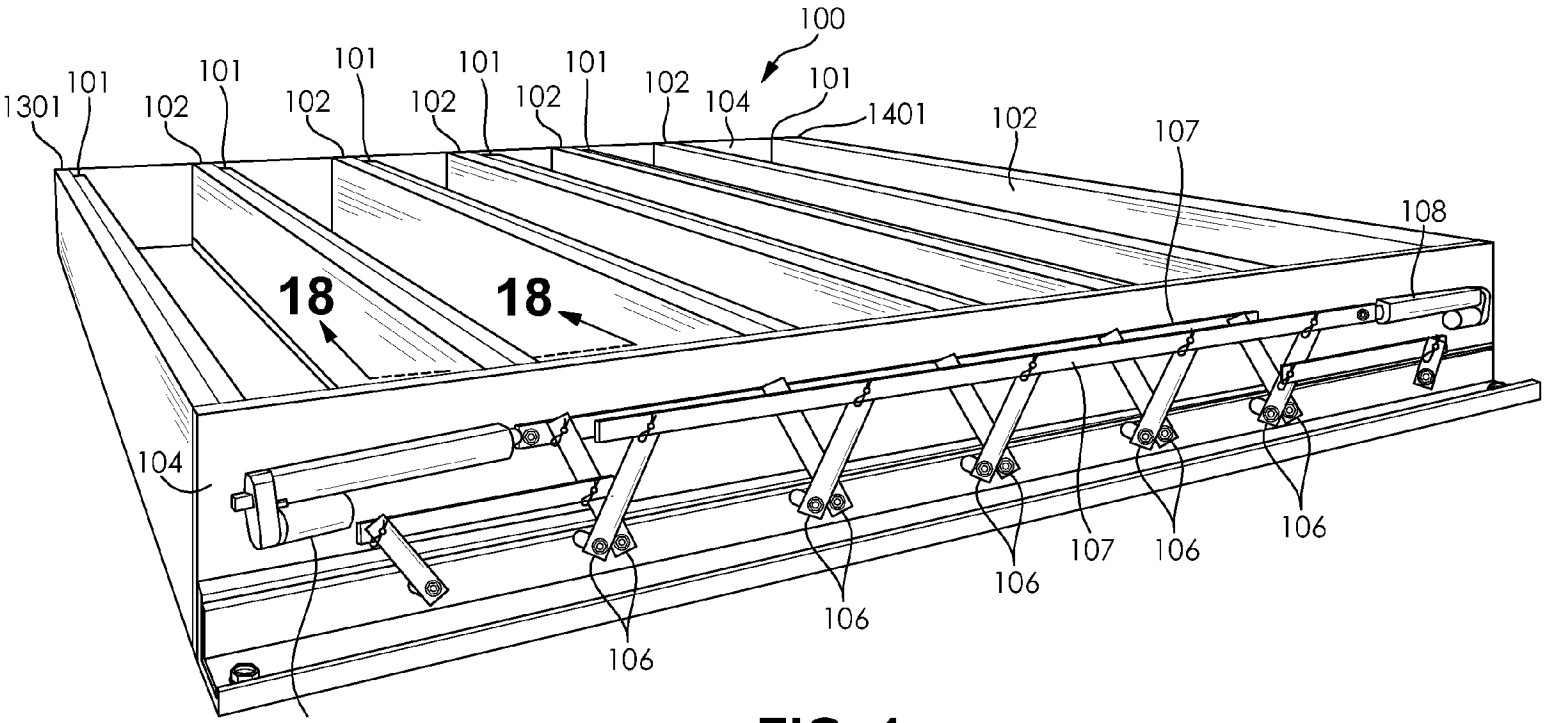
FIG. 1 shows a perspective view of the apparatus with the rafters open.

FIG. 1 shows a perspective view of the apparatus with the rafters open. The apparatus shown is a transforming awning 100. Rectangular rafters with a J cross-sectional shape 101 formed at the edge of one of the long sides and an L cross-sectional shape 102 formed at the opposing long side edge are shown in pairs, except for the rafters at the ends. The rafters are functionally connected to ledgers 104. Attached to the side of the ledgers 104 are means to open or close the rafters including linkages 106, connecting rods 107, and electric motors 108. Also shown is J-rafter housing 1301 and L-rafter housing 1401.

Figure 2:
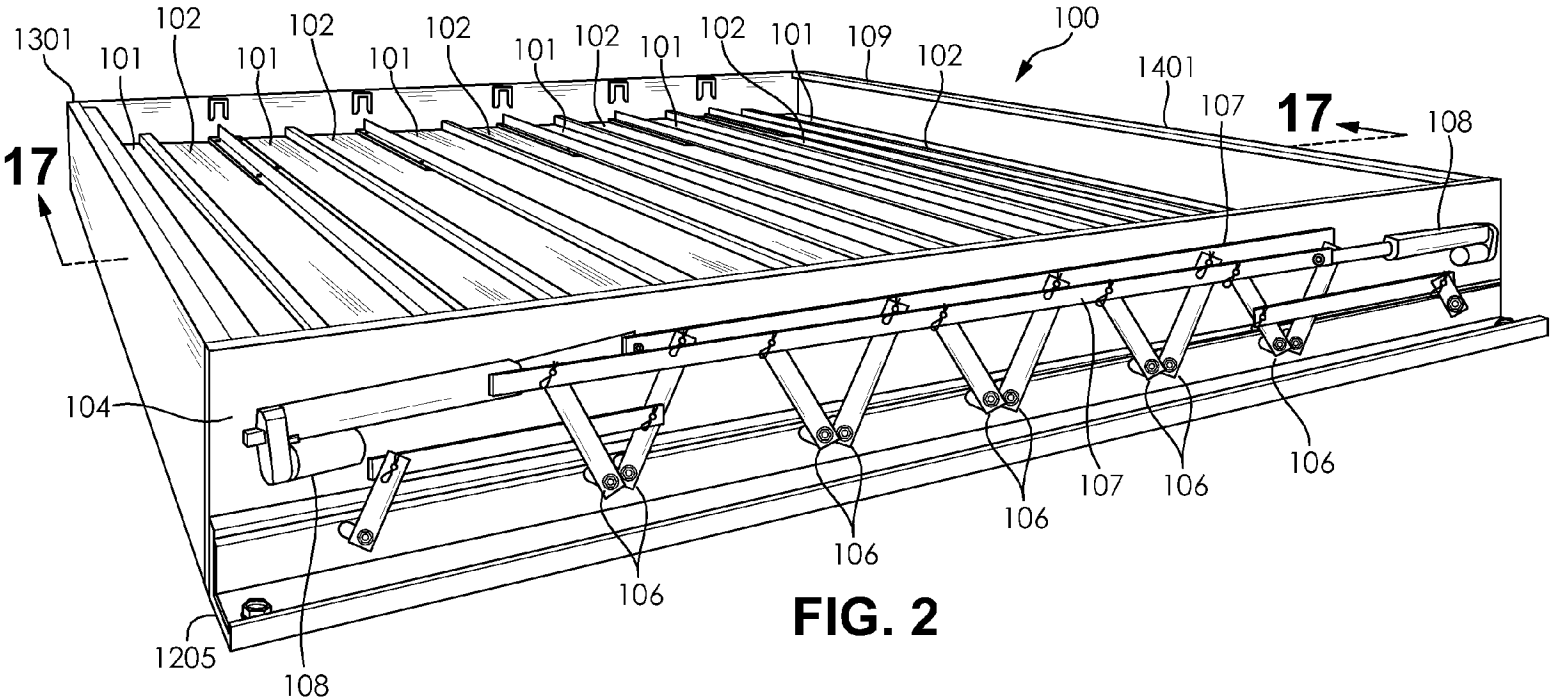
FIG. 2 shows a perspective view of the apparatus with the rafters closed.

FIG. 2 shows a perspective view of the apparatus with the rafters closed. The elements are the same as cited in FIG. 1 with the addition of end rafter housing 109 and structural angle 1205.

Figure 3:
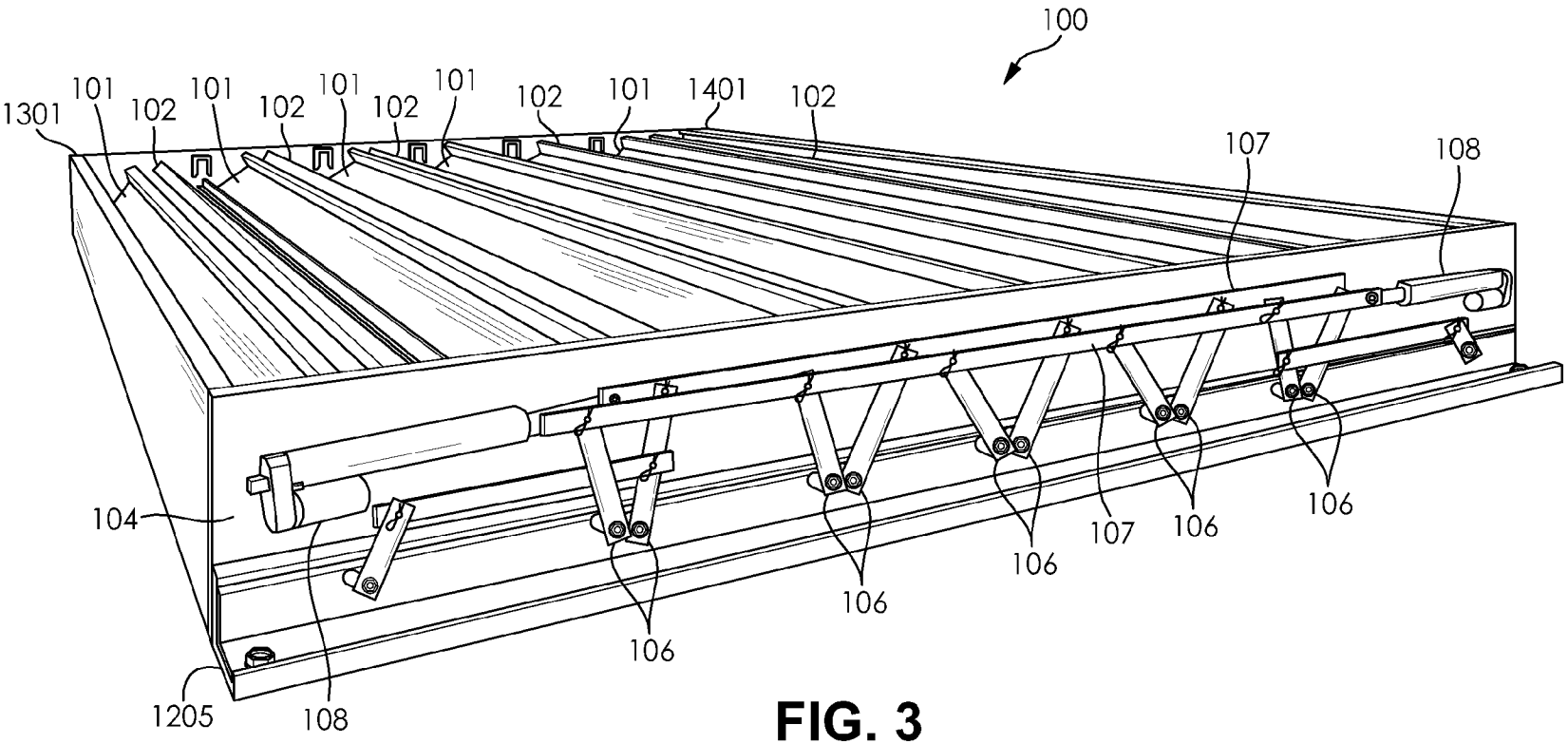
FIG. 3 shows a perspective view of the apparatus with the rafters partially open.

FIG. 3 shows a perspective view of the apparatus with the rafters partially open. The elements are the same as cited in FIG. 1 with the addition of structural angle 1205.

Figure 4:
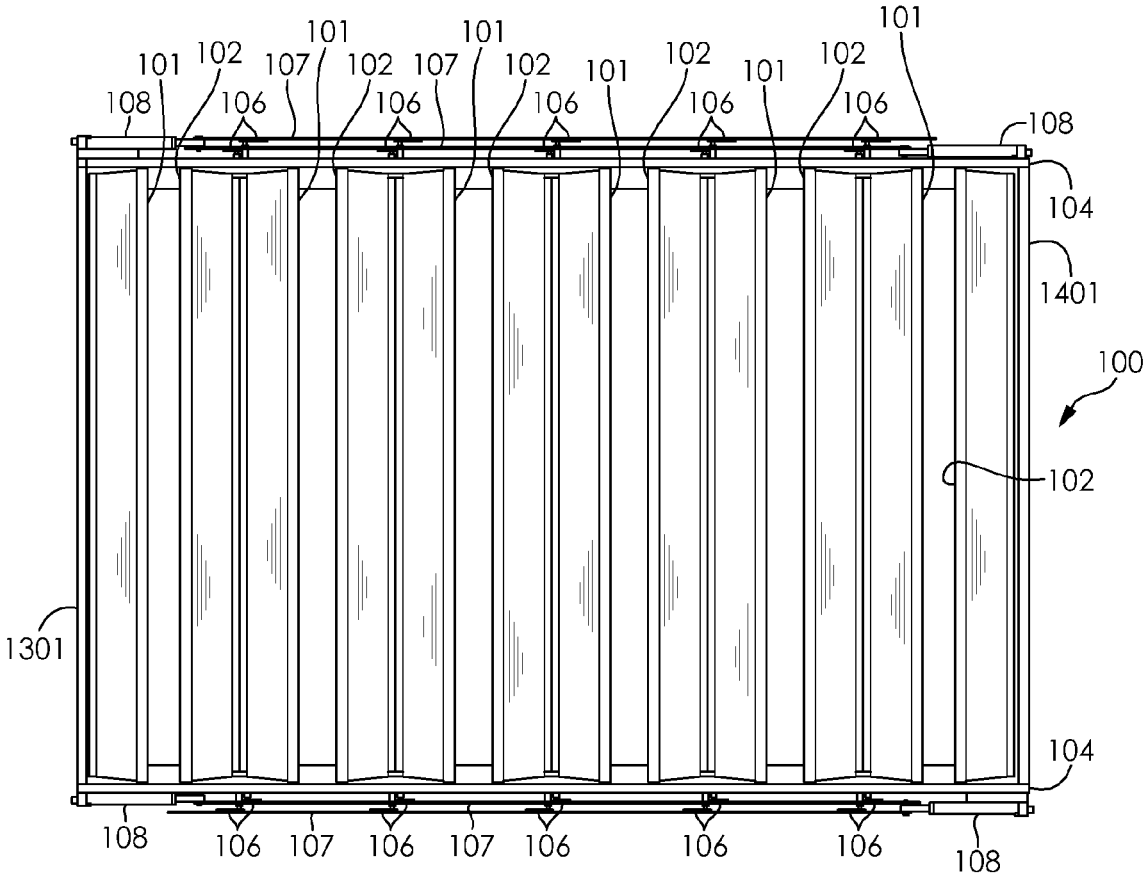
FIG. 4 shows a top view of the apparatus with the rafters partially open.

FIG. 4 shows a top view of the apparatus with the rafters partially open. The elements are the same as cited in FIG. 1.

Figure 5:
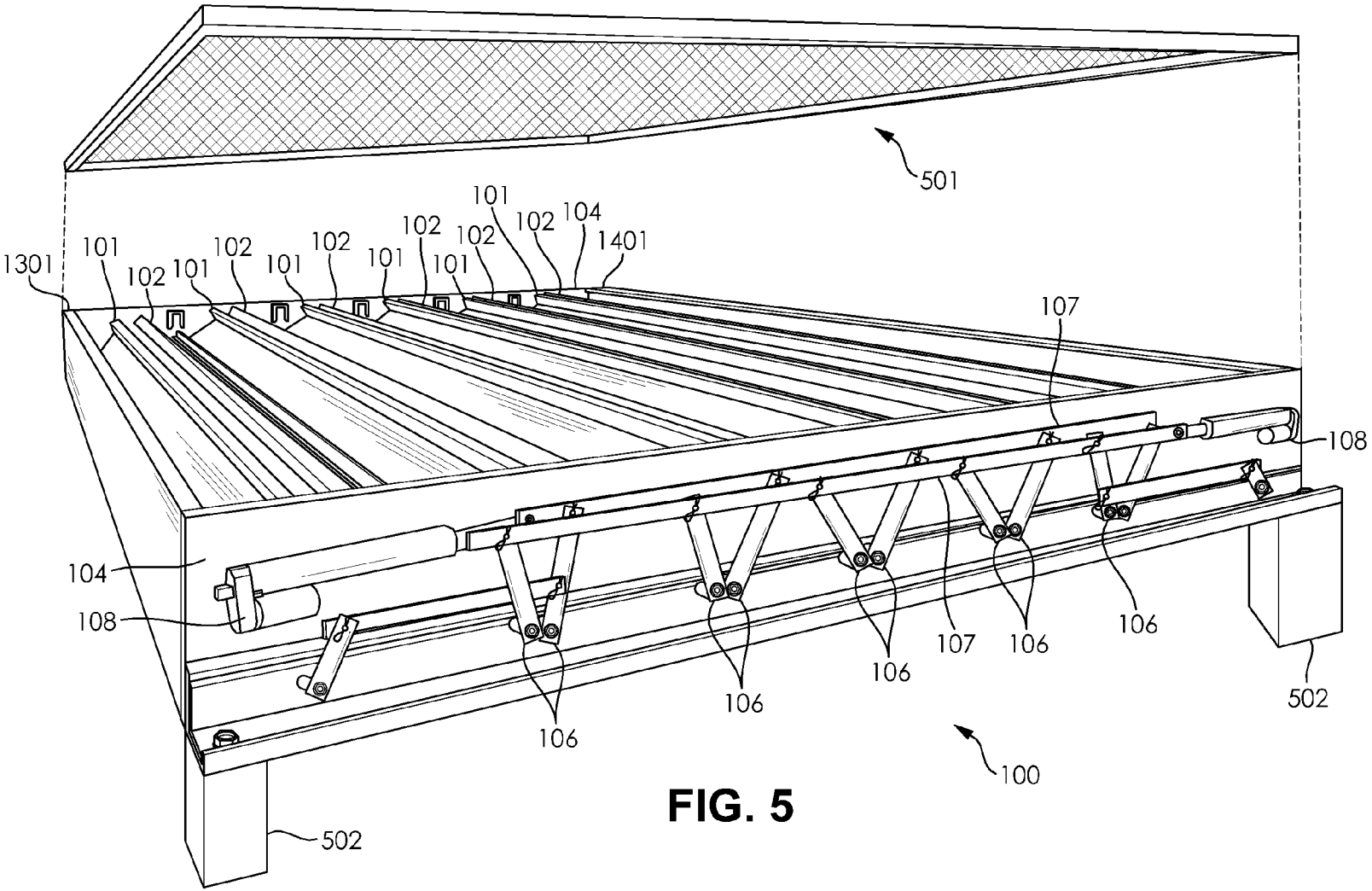
FIG. 5 shows the apparatus further comprising a screen.

FIG. 5 shows the apparatus further comprising a screen. The apparatus shown is an awning configured to transform 100. A J-rafter 101 formed at the edge of one of the long sides and an L-rafter 102 formed at the opposing long side edge are shown in pairs, except for the rafters at the ends. The rafters are functionally connected to ledgers 104. Attached to the side of the ledgers 104 are means to open or close the rafters 105 including linkages 106, connecting rods 107, and electric motors 108. A screen 501 attaches to the top of the awning configured to transform 100. Posts 502 are shown elevating the awning configured to transform 100. Also shown is J-rafter housing 1301 and L-rafter housing 1401.

Figure 6:
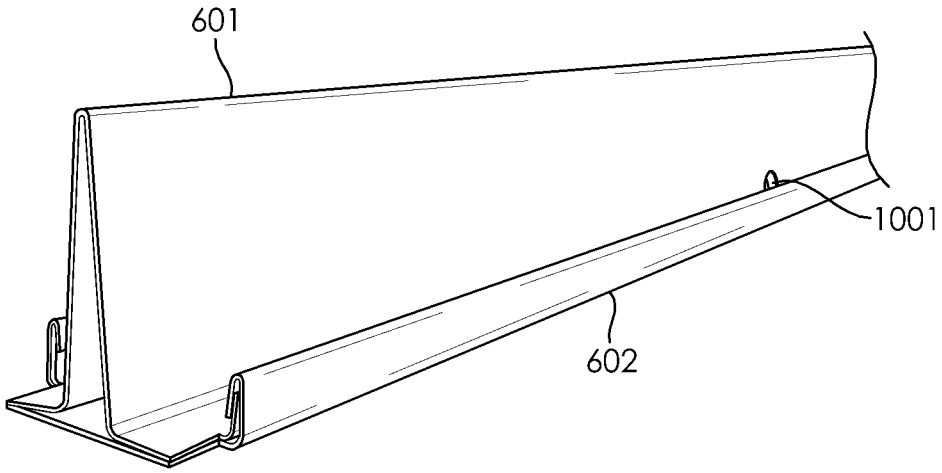
FIG. 6 is an A-strut detail with no rafters.

FIG. 6 is an A-strut detail with no rafters. An A-strut 601 is inside a strut cap 602 and extends beyond the strut cap 602. Also shown is alignment pin clearance hole 1001.

Figure 7:
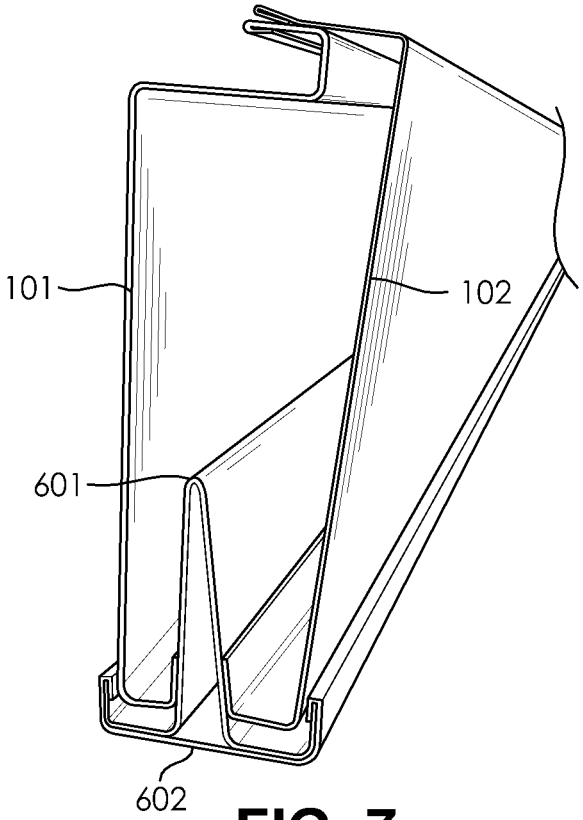
FIG. 7 is an A-strut detail with the rafters open.

FIG. 7 is an A-strut detail with the rafters open. An A-strut 601 is inside a strut cap 602. A J-rafter 101 is positioned inside an L-rafter 102.

Figure 8:
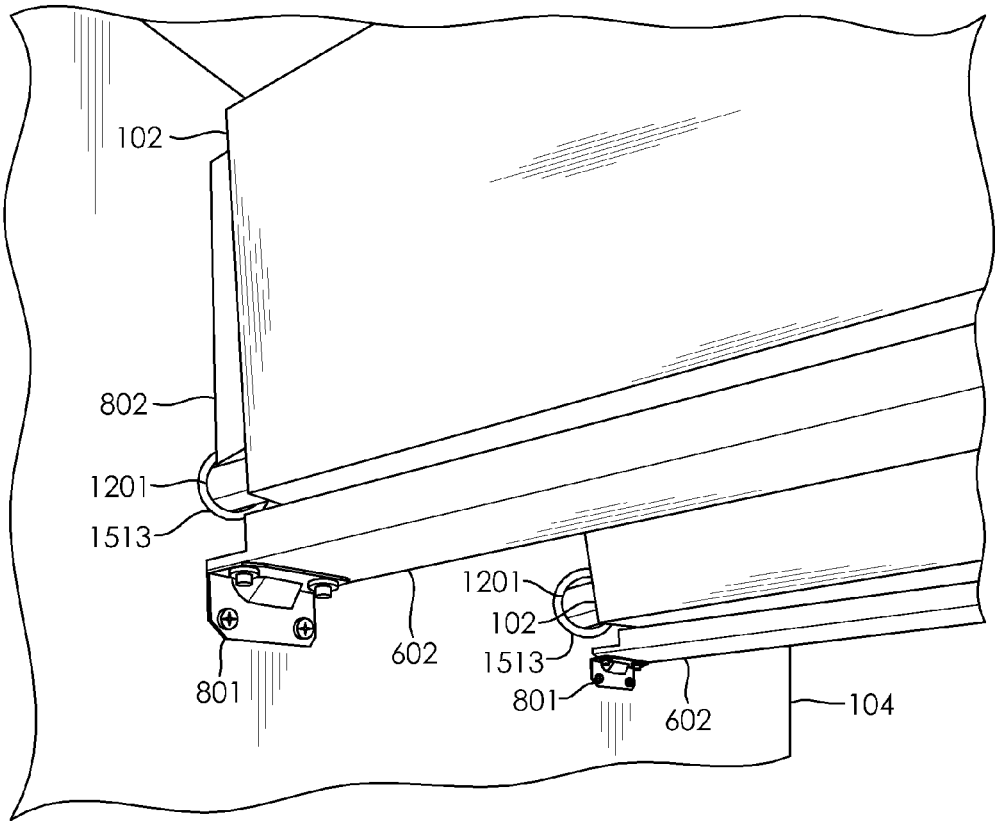
FIG. 8 is a detail of a strut cap connection to a ledger.

FIG. 8 is a detail of a strut cap connection to a ledger. A ledger fastener 801 connects the strut cap 602 to a ledger 104. A fill plate 802 has a bumper strip (not shown) to prevent rattling of the L-rafter 102 shown in the open position. Also shown are axles 1201 and axle bushings 1513.

Figure 9:
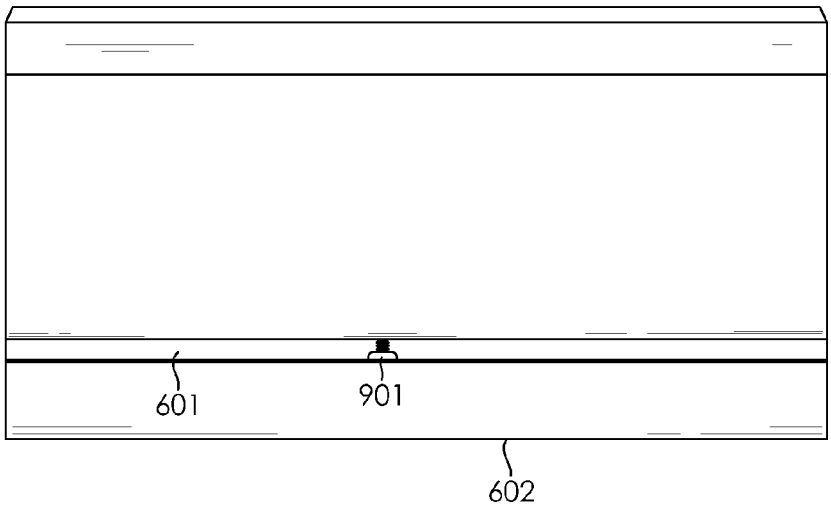
FIG. 9 is an alignment pin side-view detail.

FIG. 9 is an alignment pin side-view detail. An alignment pin 901 is used to prevent rafters from rattling and in alignment with side of A strut. Also shown are the A-strut 601, and strut cap 602.

Figure 10:
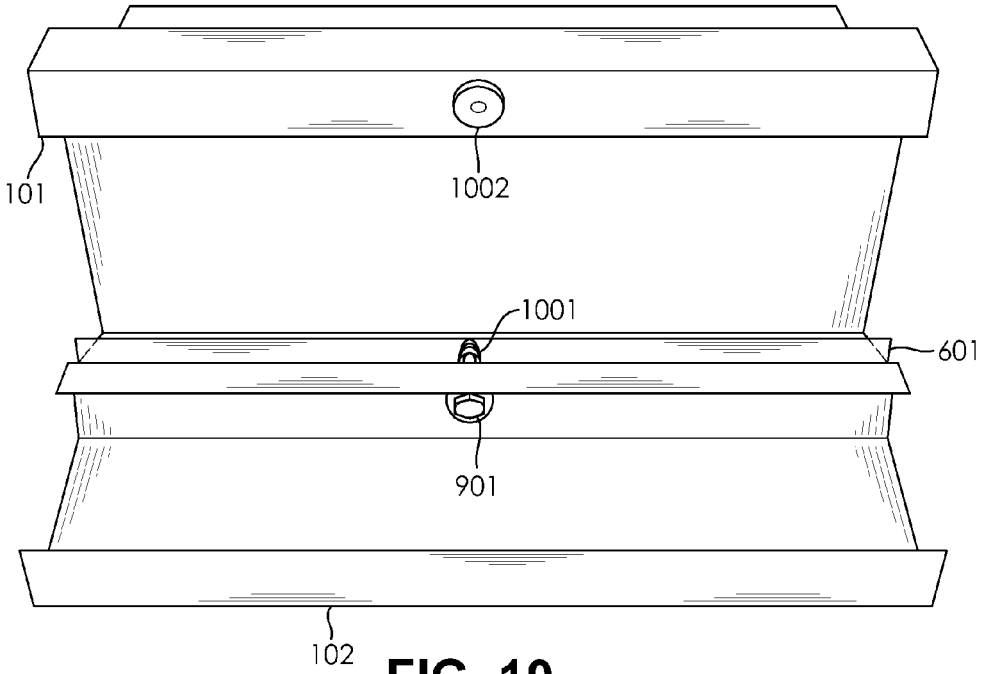
FIG. 10 is an alignment pin perspective view detail.

FIG. 10 is an alignment pin perspective view detail. The alignment pin 901 is used to prevent rafters from rattling. Shown below the alignment pin 901 is an alignment pin clearance hole 1001 for clearance of the alignment pin 901 when the apparatus is open. A bumper 1002 is also shown to prevent rattling. Also shown are J-rafter 101, L-rafter 102, and A-strut 601.

Figure 11:
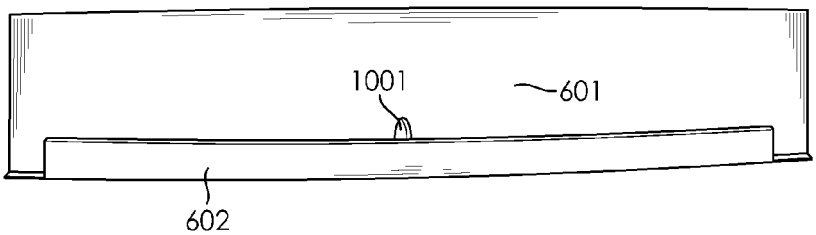
FIG. 11 is a detail of an alignment pin clearance hole for a rafter in an open position.

FIG. 11 is a detail of an alignment pin clearance hole for a rafter in an open position. The alignment pin clearance hole 1001 is located near the bottom of the A-strut 601. Also shown is strut cap 602.

Figure 12:
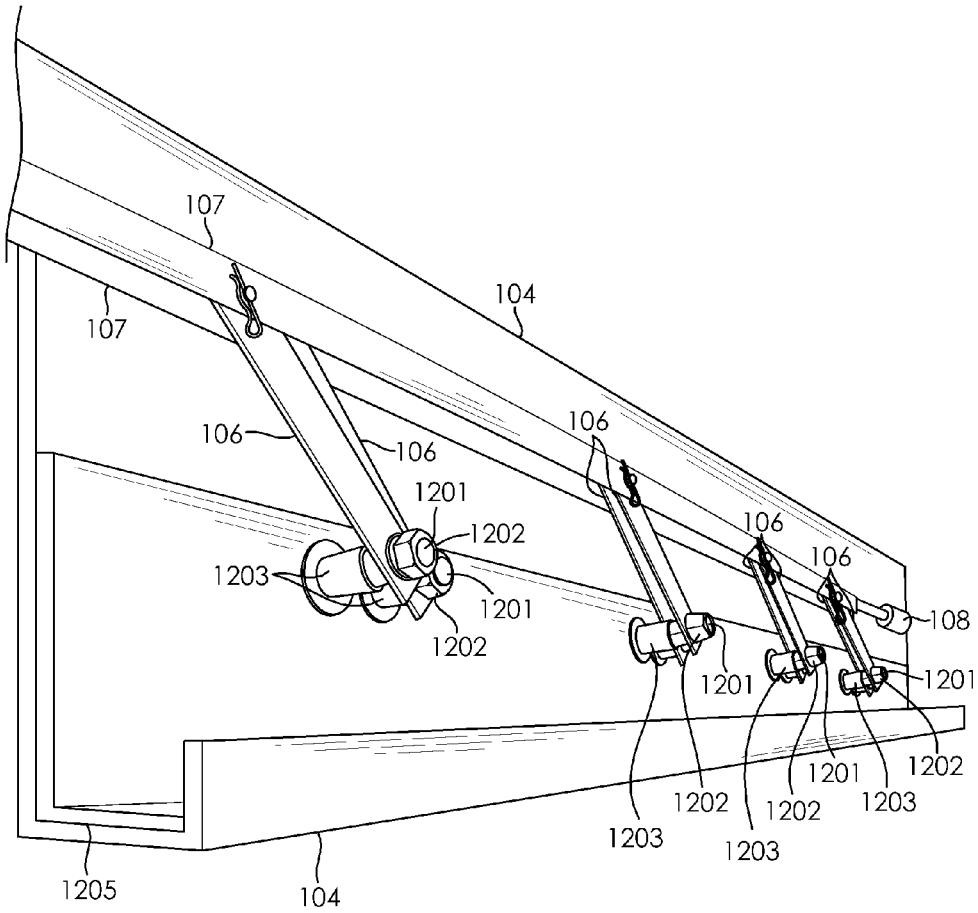
FIG. 12 shows an axle connection detail.

FIG. 12 shows an axle connection detail. Attached to the side of the ledger 104 is means to open or close the rafters including linkages 106, connecting rods 107, and electric motors 108. Axles 1201 extend through the ledgers 104 and the linkages 106. An axle fastener 1202 is used at the end of each axle 1201 to fasten the axle to the apparatus. A spacer 1203 offsets each linkage 106 from the ledger 104. Also shown is a structural angle 1205 for mounting the apparatus on a post.

Figure 13:
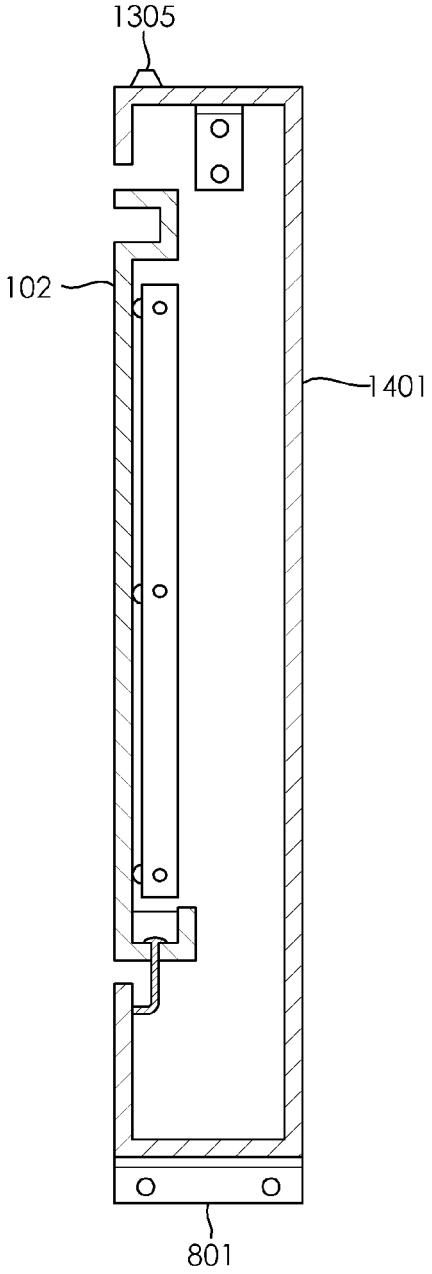
FIG. 13 is a J-end rafter detail.

FIG. 13 a J-end rafter detail. A J-rafter 101 is held within a J-rafter housing 1301 when the apparatus is open. A button snap 1305 is used to secure an optional screen (not shown). Also shown is a ledger fastener 801.

Figure 14:
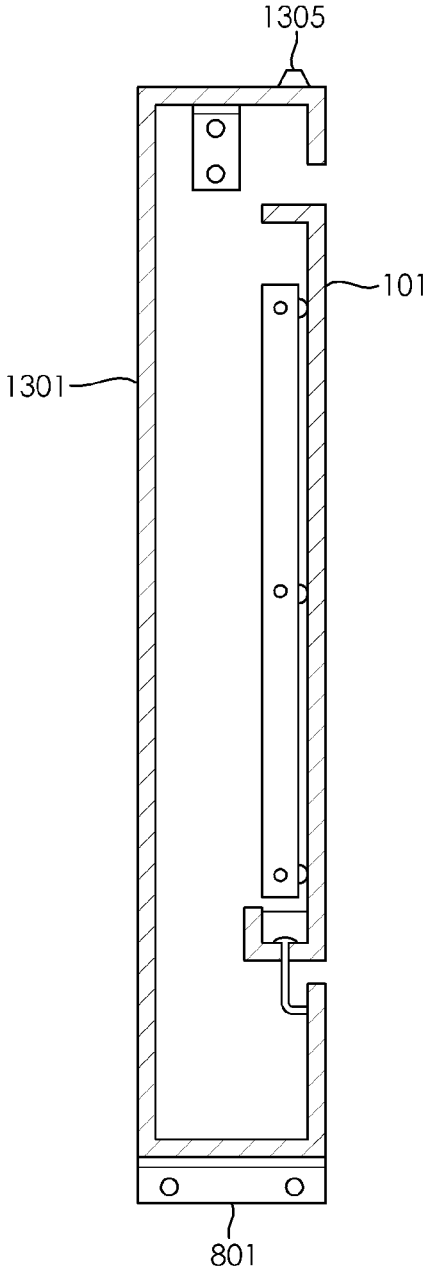
FIG. 14 is an L-end rafter detail.

FIG. 14 is an L-end rafter detail. An L-rafter 102 is held within an L-rafter housing 1401 when the apparatus is open. A button snap 1305 is used to secure an optional screen (not shown). Also shown is a ledger fastener 801.

Figure 15:
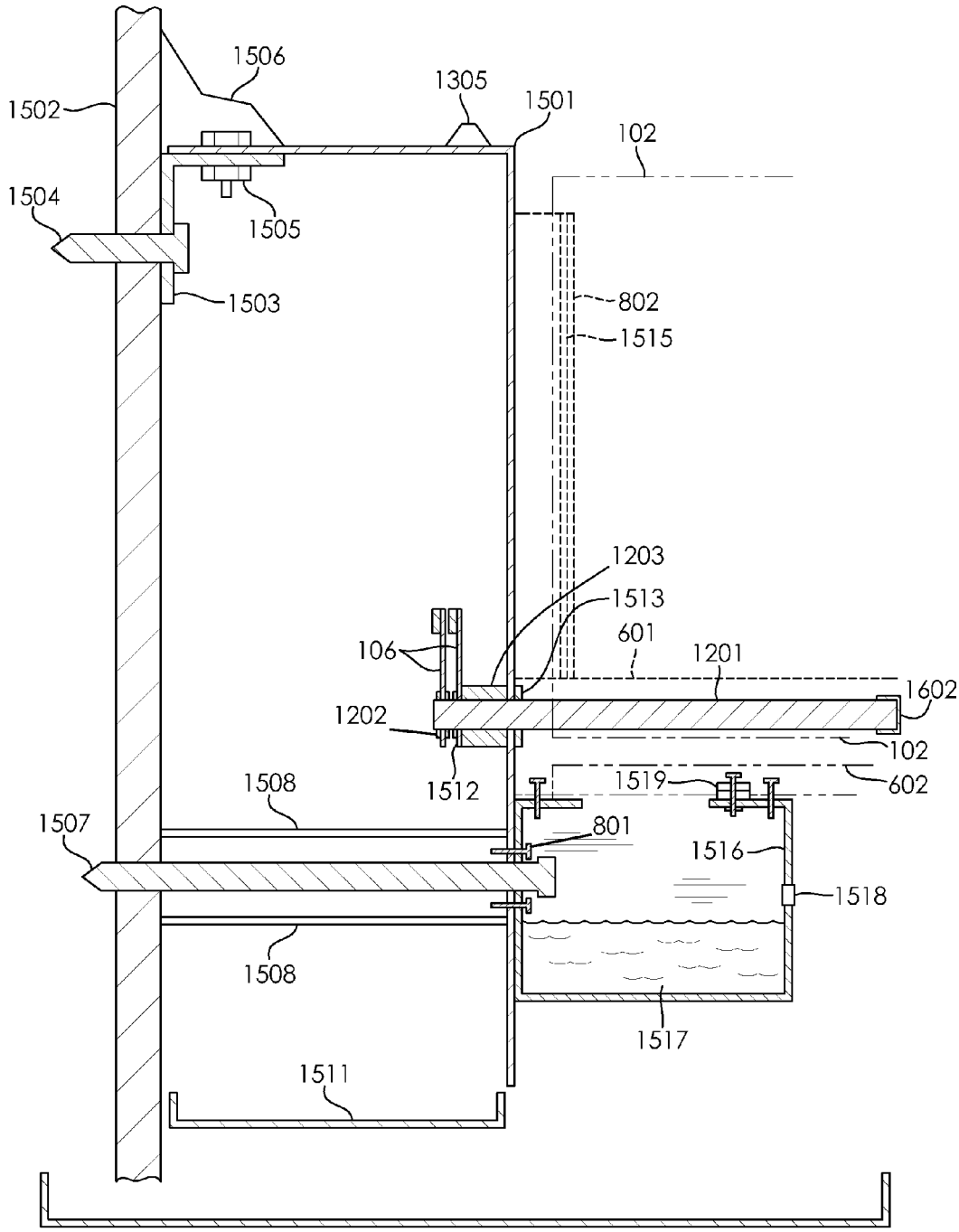
FIG. 15 is an exploded view of the apparatus attached to a wall.

FIG. 15 is an exploded view of the apparatus attached to a wall. Shown are a gutter 1516, downspout 1517, hole cover 1518, filler block with bumper strip 1519, axle washer 1512, axle bushing 1513, bumper strip 1515, axle end cap 1602, L-rafter 102, linkage 106, A-strut 601, strut cap 602, ledger fastener 801, fill plate 802, axle 1201, axle fastener 1202, spacer 1203, button snap 1305, ledger 1501, wall 1502, wall angle bracket 1503, wall fastener 1504, ledger fastener 1505, flashing 1506, ledger bottom fastener 1507, standoff tube 1508, and ledger bottom cap 1511. In this embodiment, the ledger 1501 is an L-shaped piece of metal fastened to a wall 1502 at the ledger's 1501 top and bottom. At the ledger 1501 top, a wall angle bracket 1503, wall fastener 1504, and ledger fastener 1505 are used to secure the ledger 1501 to the wall 1502. Flashing 1506 prevents precipitation from getting between the apparatus and the wall 1502. At the ledger 1501 bottom, a ledger bottom fastener 1507 and standoff tube 1508 are used to secure the ledger 1501 to the wall 1502. A button snap 1305 is used to secure an optional screen (not shown).

Figure 16:
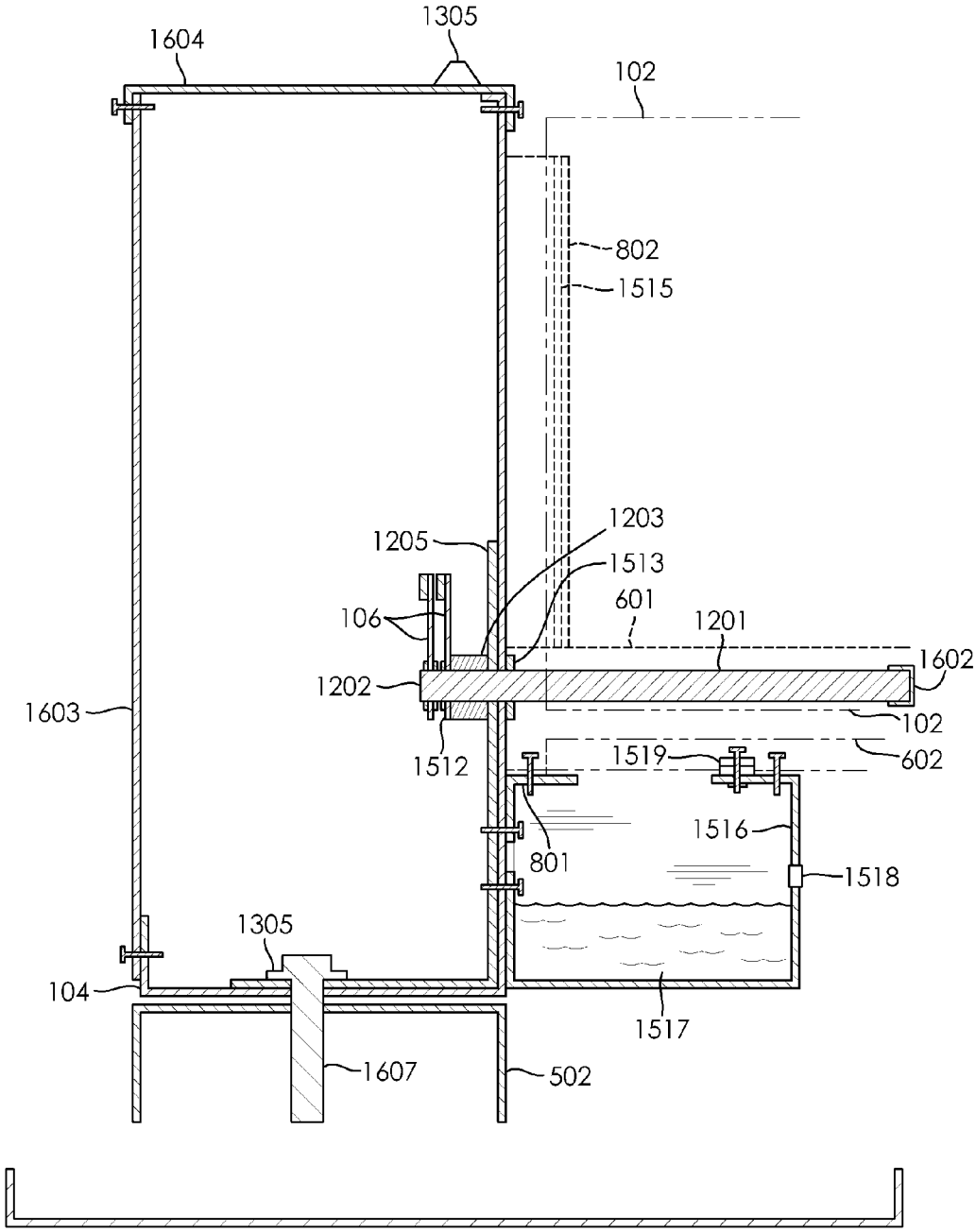
FIG. 16 is an exploded view of the apparatus on posts.

FIG. 16 is an exploded view of the apparatus on posts. Shown are L-rafter 102, ledger 104, linkage 106, A-strut 601, strut cap 602, post 502, ledger fastener 801, fill plate 802, axle 1201, axle fastener 1202, spacer 1203, structural angle 1205, button snap 1305, axle washer 1512, axle bushing 1513, bumper strip 1515, gutter 1516, downspout 1517, hole cover 1518, filler block with bumper strip 1519, axle end cap 1602, side piece 1603, top cap 1604, and fastener 1607.

Figure 17:
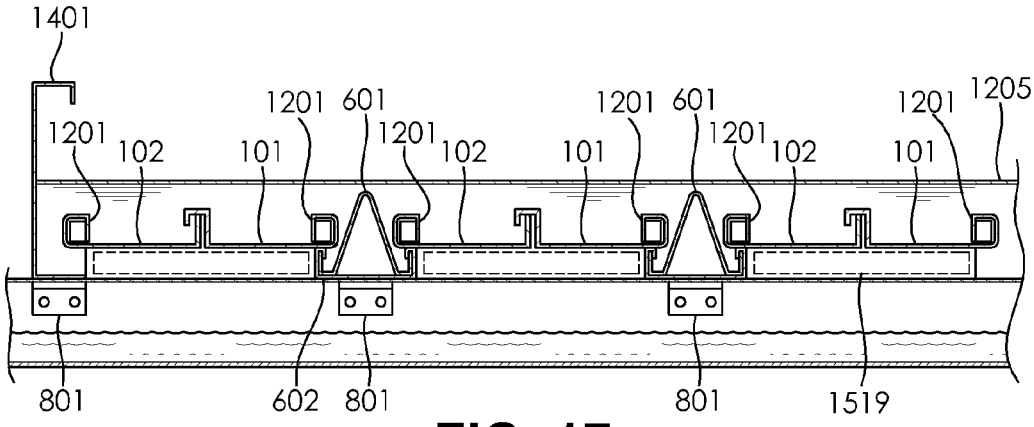
FIG. 17 is a cross-section side-view with the rafters closed.

FIG. 17 is a cross-section side-view with the rafters closed. Shown are J-rafter 101, L-rafter 102, A-strut 601, strut cap 602, ledger fastener 801, axle 1201, structural angle 1205, L-rafter housing 1401, and bumper strip 1519.

Figure 18:
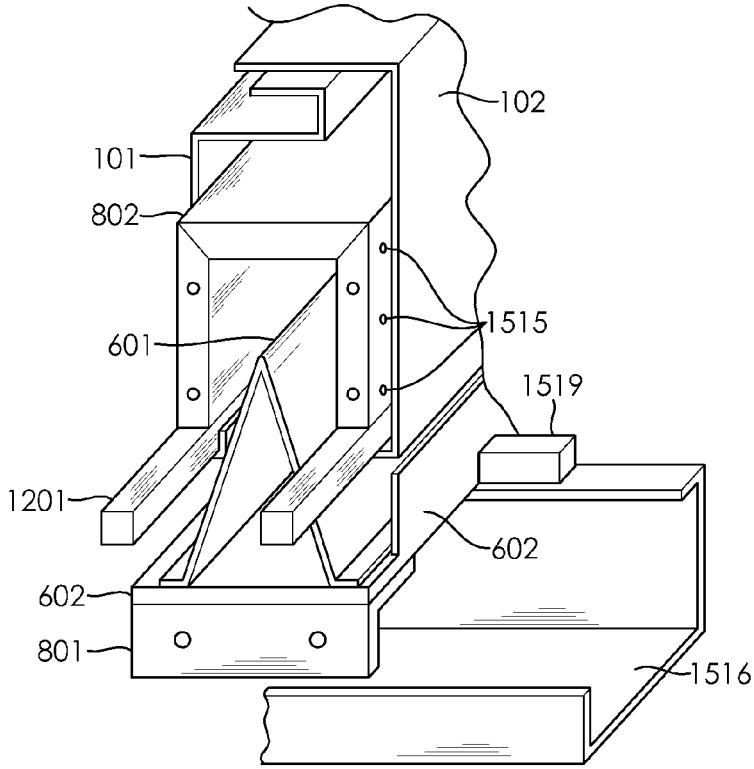
FIG. 18 is a perspective cut-out view with the rafters open.

FIG. 18 is a perspective cut-out view with the rafters open. Shown are J-rafter 101, L-rafter 102, A-strut 601, strut cap 602, ledger fastener 801, fill plate 802, bumper strip 1515, gutter 1516, and bumper strip 1519.

For the purposes of this disclosure, a pergola is not required to support any plant growth.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

I claim:

1. An awning, the awning comprising:

a plurality of rectangular rafters with a J cross-sectional shape formed at an edge of a long side and an L cross-sectional shape formed at an opposing long side edge, wherein the rafters are paired so that one rafter of a pair rotates clockwise to close and the other rafter of the pair rotates counter-clockwise to close, except for end rafters which are not paired;

two ledgers which are each functionally connected to opposing short sides of the rectangular rafters, via axles, at a face of the ledgers;

an A-strut for each pair of rafters, wherein each A-strut provides a functional connection between its respective pair of rafters and the ledgers, further wherein each A-strut is integrated with an A-strut gutter, further wherein the A-strut gutters send drainage to a ledger gutter;

a rafter housing for each end rafter;

a fill plate connected to each ledger; and means to axially rotate the rafters about a length of the rafters up to 90 degrees.

2. The apparatus of claim 1, wherein the plurality of rectangular rafters further comprise:

a rectangular side panel; and an axle with a cross-section which matches the J cross-sectional shape, runs axially along a J side of the side panel, and is secured to the side panel at the J side.

3. The apparatus of claim 2, wherein the rafters further comprise bumpers which are attached to side panels.

4. The apparatus of claim 2, wherein the rafters further comprise insulation attached to side panels.

5. The apparatus of claim 2, wherein the rafters further comprise an alignment pin in a center of each side panel.

6. The apparatus of claim 1, wherein the ledgers comprise:

a base with two long sides, two short sides, and two faces;

a gutter which runs along a length of a long side of the base; and openings with bushings which functionally connect to each axle.

7. The apparatus of claim 1, wherein the means to axially rotate the rafters about a length of the rafters up to 90 degrees comprise:

a plurality of connecting rods with a hole to match a cross-sectional shape of axles, each connecting rod being functionally attached to an end of one axle;

a first linkage rod for each ledger which is able to transfer force to a first of each paired rafter via the connecting rods and axles;

a second linkage rod for each ledger which is able to transfer force to a second of each paired rafter via the connecting rods and axles;

means to exert force upon the first linkage rod; and means to exert force upon the second linkage rod.

* * * * *